US007226030B2

(12) United States Patent
Burnett-Evans et al.

(10) Patent No.: US 7,226,030 B2
(45) Date of Patent: Jun. 5, 2007

(54) BOOK HOLDER

(75) Inventors: Peter Burnett-Evans, Nassau (BS); Amanda Burnett-Evans, Vancouver (CA); Michel Dallaire, Montreal (CA); Marc Lamontagne, Montreal (CA); Nicolas Pellemans, Laval (CA)

(73) Assignee: Burnett-Evans Holdings, Inc., Nassau (BS)

( * ) Notice: Subject to any disclaimer, the term of this patent is extended or adjusted under 35 U.S.C. 154(b) by 0 days.

(21) Appl. No.: 11/128,015

(22) Filed: May 11, 2005

(65) Prior Publication Data

US 2005/0253038 A1 Nov. 17, 2005

Related U.S. Application Data

(60) Provisional application No. 60/571,909, filed on May 17, 2004.

(51) Int. Cl.
*A47B 97/04* (2006.01)

(52) U.S. Cl. ..... 248/447; 248/453; 248/460; 248/463

(58) Field of Classification Search ..... 248/447, 248/451, 453, 441.1, 460, 463, 464; 281/28, 281/33, 42, 45
See application file for complete search history.

(56) References Cited

U.S. PATENT DOCUMENTS

| | | | | |
|---|---|---|---|---|
| 571,254 | A | 11/1896 | Whitmore | |
| 825,072 | A | 7/1906 | Power et al. | |
| 1,570,973 | A | 1/1926 | Simonelli | |
| 1,959,843 | A | 5/1934 | Sprague | |
| 2,278,143 | A | 3/1942 | Matthews | |
| 3,076,285 | A | 2/1963 | Sparkman | |
| 3,198,475 | A | 8/1965 | Flahive | |
| D212,614 | S | 11/1968 | Taylor | |
| 3,514,066 | A | 5/1970 | Singleton et al. | |
| 3,737,178 | A | 6/1973 | Tjernlund et al. | |
| 3,813,075 | A | 5/1974 | Capper | |
| 3,833,197 | A | 9/1974 | Dyke | |
| 3,894,709 | A | 7/1975 | Weir | |
| 3,991,967 | A | 11/1976 | Sack | |
| 4,145,022 | A | 3/1979 | Comfort | |
| 4,474,383 | A | 10/1984 | Kikis | |
| 4,508,307 | A | 4/1985 | Morales | |
| 4,553,728 | A * | 11/1985 | Corsello | 248/452 |
| 4,666,409 | A | 5/1987 | Sandberg | |
| 4,712,760 | A * | 12/1987 | Winter | 248/451 |
| 4,832,303 | A | 5/1989 | Myeeo | |
| 4,948,082 | A | 8/1990 | Pagano | |

(Continued)

FOREIGN PATENT DOCUMENTS

| | | |
|---|---|---|
| DE | 387312 | 12/1923 |

(Continued)

OTHER PUBLICATIONS

Taiwanese Technical Report dated Feb. 17, 2006.

*Primary Examiner*—Korie Chan
(74) *Attorney, Agent, or Firm*—Stroock & Stroock & Lavan LLP

(57) ABSTRACT

The book holder has displaceable arms and a back member that can facilitate retaining a book in an open displayed manner. The book holder can either be handheld or be placed or attached on a supporting surface.

64 Claims, 4 Drawing Sheets

U.S. PATENT DOCUMENTS

| | | | | |
|---|---|---|---|---|
| 5,016,852 | A | | 5/1991 | Herendeen |
| 5,069,409 | A | | 12/1991 | Batson |
| 5,382,054 | A | | 1/1995 | Bettiol |
| 5,388,798 | A | | 2/1995 | Glick |
| D361,092 | S | | 8/1995 | Batson |
| 5,445,416 | A | | 8/1995 | Zareck |
| 5,660,365 | A | | 8/1997 | Glick |
| 5,720,465 | A | | 2/1998 | Peltzer et al. |
| 5,722,691 | A | * | 3/1998 | Patel ..... 281/42 |
| 5,868,099 | A | | 2/1999 | Begin |
| 5,979,940 | A | | 11/1999 | Araghi |
| D421,063 | S | | 2/2000 | Davidson |
| 6,019,339 | A | | 2/2000 | Brayford |
| 6,068,299 | A | | 5/2000 | Peltzer |
| 6,089,609 | A | | 7/2000 | Denley |
| 6,109,658 | A | | 8/2000 | Moore |
| 6,439,612 | B1 | | 8/2002 | Greer |
| 6,499,713 | B1 | | 12/2002 | Paoluccio |
| 6,619,609 | B2 | | 9/2003 | Cress |
| 6,736,581 | B1 | | 5/2004 | Cassoni et al. |

FOREIGN PATENT DOCUMENTS

| | | |
|---|---|---|
| DE | 39 03 543 | 3/1990 |
| GB | 508800 | 7/1939 |
| TW | 079201857 | 3/1994 |
| TW | 535531 | 6/2003 |
| WO | WO 03/047391 | 6/2003 |
| WO | WO 2004/103720 | 12/2004 |
| WO | WO 2004/105552 | 12/2004 |

* cited by examiner

BOOK HOLDER

CROSS-REFERENCE TO RELATED APPLICATION

This application claims the benefit of U.S. Provisional Application Ser. No. 60/571,909, filed May 17, 2004, entitled BOOK HOLDER, which is hereby incorporated herein by reference.

BACKGROUND

There are various methods of holding a book open, such as using two hands or the thumb and a finger of one hand to retain the pages back. Other known methods include applying pressure with one or two hands on a stable surface, such as a table or the lap of the reader. However, these methods can provide discomfort to the reader after a prolonged time.

Various products exist in the market to address this problem. For example, there are book holders that permit the reader to place the book on a stand on a desk or other flat, stable surface. These book holders, however, are limited in their use or ease of operation. Tabletop book holders limit the position and location in which a reader can read the book. For example, a reader cannot use a tabletop book holder when reading in bed, on the sofa, in a bath, in the gym, when traveling, etc. The book holders currently known are generally too cumbersome to carry during travel, making it impractical.

SUMMARY

A new book holder is hereby presented for maintaining a book in an open displayed manner. This new book holder is more practical and more convenient than the ones known in the past.

In one aspect, there is provided a book holder comprising a back member, two opposite arms cooperatively supported by the back member so that the arms are independently displaceably biased against the back member, and two finger-actuated levers, each lever being connected to one corresponding arm to displace the corresponding arm, thereby selectively displacing the corresponding arm away from the back member.

In one aspect, there is provided a book holder comprising: a back member; two opposite and independently-displaceable arms pivotally connected to the back member; two page pressing members, each page pressing member being connected to one corresponding arm, the page pressing members, the arms and the back member defining a book receiving area to receive an edge of the book; means for biasing the arms so as to urge the page pressing members toward the back member; and two finger-actuated levers, each lever being connected to one corresponding arm to pivot it, when depressed, thereby displacing the corresponding page pressing member away from the back member.

In another aspect, there is provided a book holder to be attached to a bottom or an upper edge of an opened book, the book generally defining a spinal axis and a transversal axis that is perpendicular to the spinal axis, the book holder comprising: a back member generally extending in the transversal axis; two opposite arms generally extending in the transversal axis, the arms being movable between a first and a second position, whereby opposite free ends of the arms are closer to the back member when the arms are in their first position than in their second position, each arm being provided with a page pressing member that is connected thereto and is generally extending parallel to the spinal axis; means for operatively connecting the arms at a medial position on the back member; at least one spring configured and disposed to urge the arms toward their first position; and means for selectively moving at least one of the arms, using a finger-generated force, toward its second position.

In another aspect, there is provided a book holder comprising: a back member; a pair of spaced-apart and substantially parallel flanges projecting from a front side of the back member, one of the flanges defining a central support surface; two oppositely-disposed arms, each arm having a first end, a second end and an elongated body, the first ends of the arms being positioned between the flanges, the body of each arm defining a lateral support surface, the lateral support surfaces being coplanar with the central support surface; at least one pivot pin mounted between the flanges and connecting the first ends of the arms to the flanges; at least one spring cooperating with the arms to bias the second ends of the arms toward the back member; and two finger-actuated levers, each lever being connected to the first end of the corresponding arm and being located opposite the body of the corresponding arm with reference to pivot pin.

In another aspect, there is provided a book holder comprising: a back member; a pair of spaced-apart and substantially parallel flanges projecting from a front side of the back member, one of the flanges defining a central support surface for an edge of the book; two oppositely-extending arms, each arm having an elongated body provided with opposite first and second ends, the first ends of the arms being positioned between the flanges and pivotally connected thereto, the body of each arm defining a lateral support surface for an edge of the book, the lateral support surfaces being substantially coplanar with the central support surface; at least one spring cooperating with the arms to bias the second ends the arms toward the back member; a finger-actuated lever, the lever being mechanically connected to the first end of a first one of the arms and extending opposite the body of the corresponding arm; and means for pivoting a second one of the arms so as to move the second end of the second arm away from the back member; whereby the finger-actuated lever, when depressed, moves the second end of the first arm away from the back member.

In another aspect, there is provided a method of inserting an edge of an open book into a book holder, the edge of the book having a first and a second side, the method comprising the steps of: depressing a first finger-actuated lever for moving a first transversal arm and thereby lifting a first page pressing member to create a first space for inserting the first side of the edge of the book between the first page pressing member and a back member of the book holder; depressing a second finger-actuated lever for moving a second transversal arm and thereby lifting a second page pressing member to create a second space for inserting the second side of the edge of the book between the second page pressing member and the back member; releasing the first lever; and releasing the second lever, whereby releasing the first and the second levers allows the first and the second page pressing member to rest against pages of the book as they are each being biased by a spring force so that the book is being held between the page pressing members and the back member.

In another aspect, there is provided a method of turning pages of a book from a first to a second side using a book holder holding the book in an open displayed manner, the book holder comprising opposite first and second page pressing members, each page pressing member being biased in contact with pages of one corresponding side of the opened book, the method comprising: lifting the first page pressing member from the pages of the first side of the book upon applying a first depressing force on a first finger-actuated lever and moving the first transversal arm on which the first page pressing member is connected; moving at least one of the pages from the first side of the book towards the second side thereof; lifting the second page pressing member upon applying a second depressing force on a second finger-actuated lever and moving a second transversal arm on which the second page pressing member is connected; and inserting the at least one page taken from the first side onto the second side of the book.

BRIEF DESCRIPTION OF THE FIGURES

In the figures, which are merely illustrative, and wherein like reference characters denote similar elements throughout the several views.

DETAILED DESCRIPTION

Figure 1:
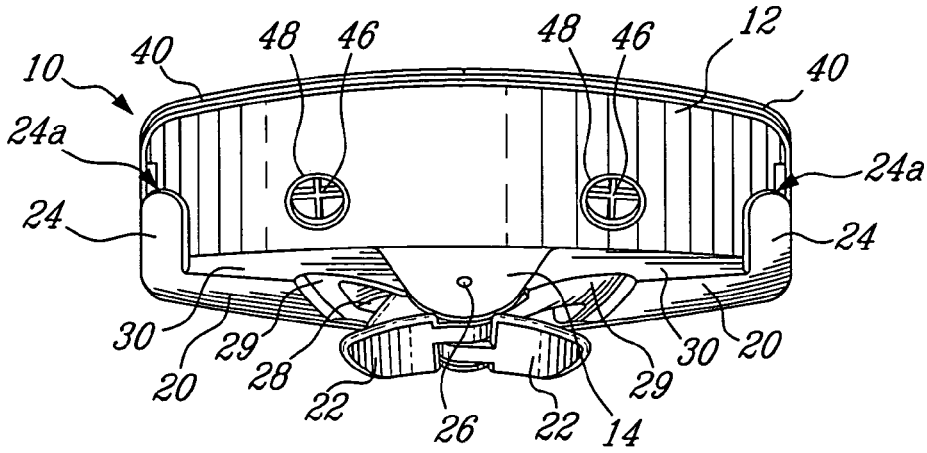
FIG. 1 is a front top perspective view of a book holder constructed in accordance with one possible embodiment.
Figure 2:
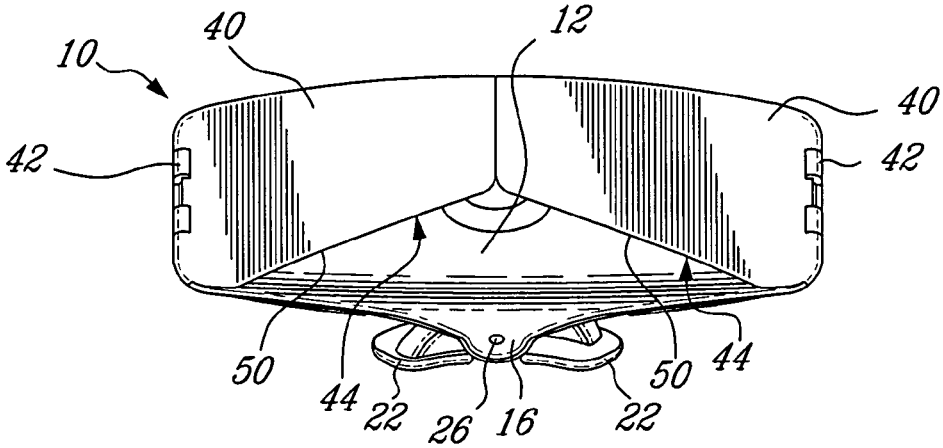
FIG. 2 is a rear bottom perspective view of the book holder of FIG. 1.
Figure 3:
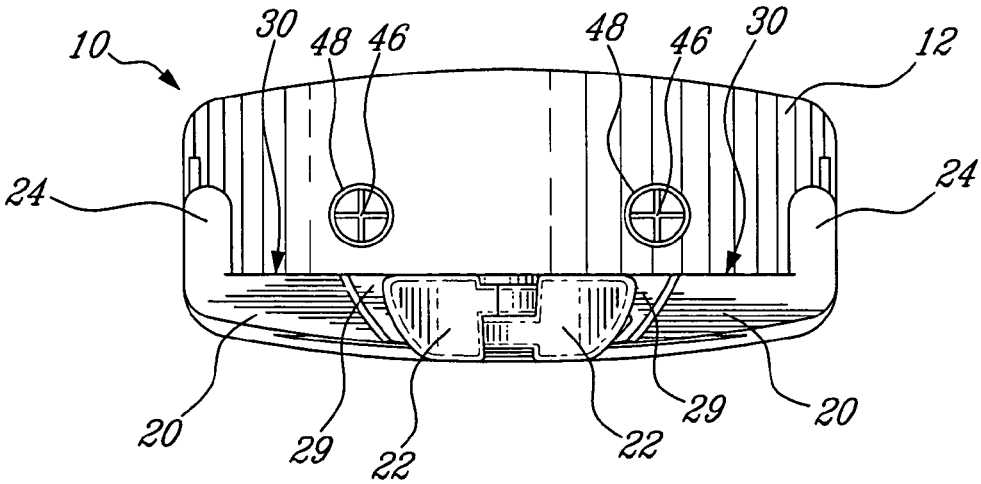
FIG. 3 is a front elevation view of the book holder of FIG. 1.
Figure 4:
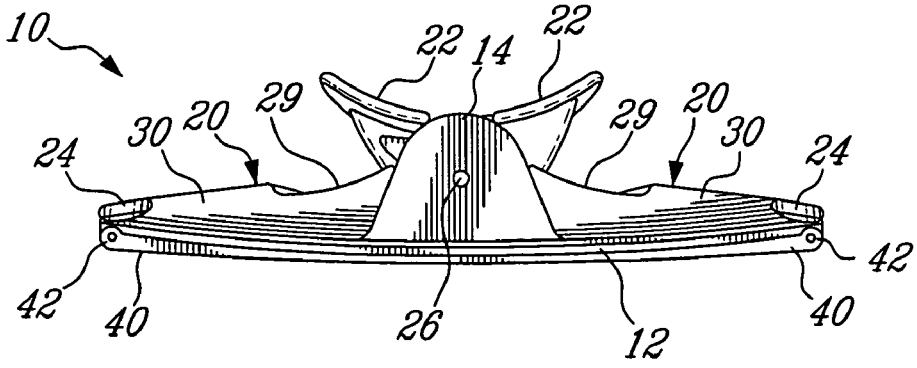
FIG. 4 is a top view of the book holder of FIG. 1.
Figure 5:
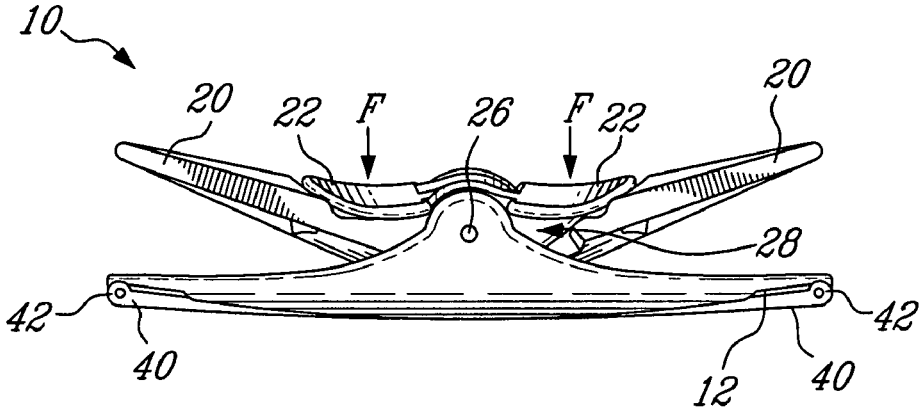
FIG. 5 is a bottom view of the book holder of FIG. 1, showing both levers being depressed.
Figure 6:
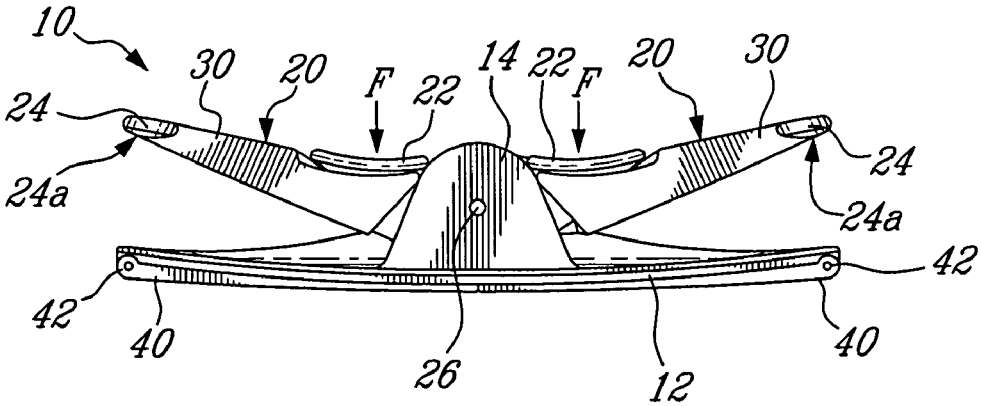
FIG. 6 is a view similar to FIG. 4, showing both levers being depressed.
Figure 7:
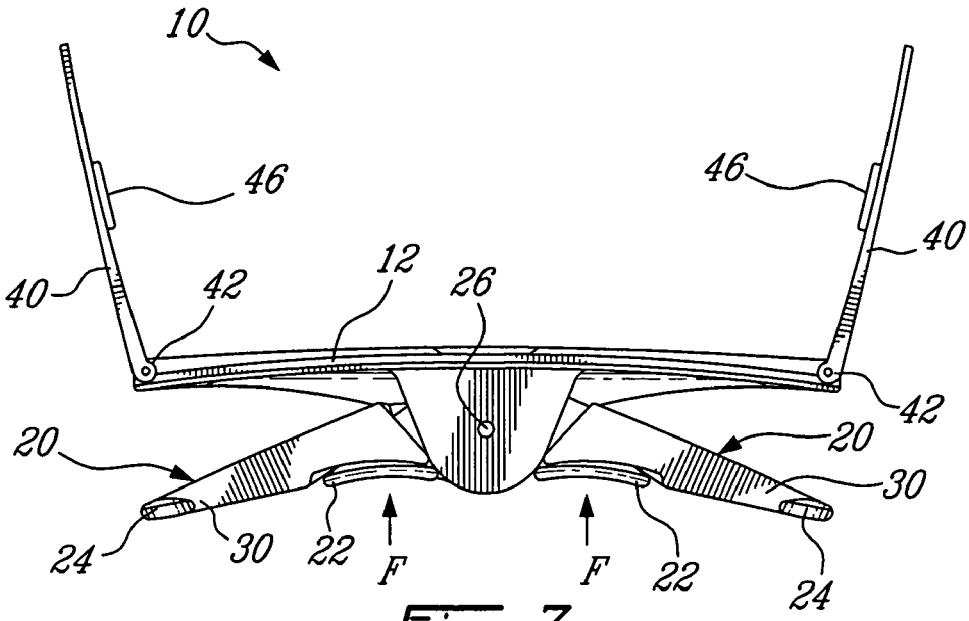
FIG. 7 is a view similar to FIG. 6, showing the rear supporting flaps being opened.
Figure 8:
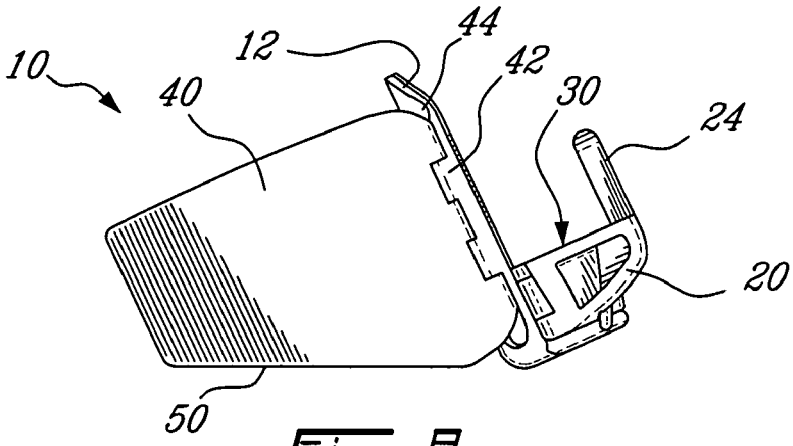
FIG. 8 is a side view of the book holder of FIG. 6.

Reference is first made to FIGS. 1 to 8, wherein a book holder 10 constructed in accordance with a possible embodiment is shown. This book holder 10 is designed to hold a book in an open displayed manner, thereby facilitating reading and handling of the book by its user. The book is held open when the book holder 10 is positioned across an edge of the book, which edge is usually the bottom or upper edge thereof. This relieves the user from exerting a force on the pages of the book to keep it open. Books of various types, sizes and shapes can be used with the book holder 10. The book holder 10 may also have different sizes and shapes, depending on the needs. This includes books with hard or soft covers and any other kinds of printed publications with pages bound or otherwise attached so as to be displayed on two or even more juxtaposed sides, for instance magazines, brochures, catalogs, restaurant menus, etc.

Referring now to the embodiment of FIGS. 1 to 8, the book holder 10 includes a back member 12 and two opposite displaceable arms 20 that are substantially parallel to the back member 12. The back member 12 is shaped as a mostly flat part extending substantially in a transversal axis, although it is slightly curved in the transversal plane to better fit at the back of a regular paperback book. The bottom edge of the book holder 10 also has a slight curve to comfortably fit in a user's hand.

The arms 20 of the embodiment illustrated in FIGS. 1 to 8 are independently movable, meaning that one can be displaced over at least most of its full stroke or range without displacing the other. Each arm 20 comprises an elongated body extending between two ends. Two of the ends of the arms are positioned one over the other and the other ends are opposite free ends. The arms 20 have an identical length, although it is possible to provide arms having two different lengths, if desired.

Each arm 20 is provided with a corresponding page pressing member 24 at the free end thereof. In the illustrated embodiment, the page pressing members 24 are in the form of tabs substantially extending in a direction parallel to the back member 12. The page pressing members 24 are configured and disposed for engaging the opened pages of a book when a book is set in the book holder 10. Each page pressing member 24 comprises a friction lining 24*a* on a side facing the back member 12, which friction linings provides an increased friction between the page pressing members 28 and the surface of the page being engaged, thereby substantially preventing the page from sliding out. Examples of friction linings include, but are not limited to, rubber pads, fabric pads, ridges made in the same material than that of the page pressing members 24, etc.

The arms 20 are configured and disposed to pivot about a common pivot point, which in the case of the illustrated embodiment consists of a pivot pin 26 mounted between two spaced-apart flanges 14, 16 orthogonally projecting from a medial location at the front bottom side of the back member 12, thereby operatively connecting the arms 20 to the back member 12. The adjacent ends of the arms 20 at the center of the book holder 10 have a rounded shape and are designed as superposed complementary members. The pivot pin 26 extend through a hole made in each end.

A torsion spring 28 is nested between the flanges 14, 16 and cooperate with the arms 20 so as to bias the page pressing members 24 toward the back member 12. One branch of the spring 28 is connected to one arm 20 and the other branch of the spring 28 is connected to the other arm 20. Therefore, when a book is present in the book holder 10, the two page pressing members 24 are pressed against the pages of the book. The book will then be held in position between the page pressing members 24 and the back member 12 due to the constant spring force.

The back member 12, the arms 20 and the page pressing members 24 define a book receiving area to receive one of the edges of the open book. In the illustrated embodiment, the uppermost flange 14 of the pair of flanges 14, 16 define a central support surface over which the edge of the central portion of the book will rest. Each arm 20 also defines a lateral support surface 30 designed to be coplanar or substantially coplanar with the central support surface to further support the book.

The illustrated book holder 10 comprises a pair of finger-actuated levers 22 configured and disposed to be depressed for displacing the arms 20. Each lever 22 is connected to one end of corresponding arm 20, more specifically the end that is adjacent to the pivot pin 26. One lever 22 is associated with the right arm 20 and the other is associated with the left arm 20. The levers 22 are disposed in a crisscross compact configuration so that each lever 22, when depressed toward the back member 12, can pivot its corresponding arm 20 and the corresponding page pressing member 24 in a direction opposite that of the force generated by spring 28. For example, if left lever 22 is depressed toward the back member 12, the right arm 20 is lifted away from back member 20, creating a space between the right page pressing member 24 and the back member 12 for inserting one of the sides of the edge of the book. When one of the levers 22 is released, the corresponding arm 20 and page pressing members 24 are set back to their page pressing position. In the illustrated embodiment, each lever 22 is made integral with the corresponding arm 20 and also the corresponding page pressing member 24. For instance, if made of plastic, these elements can be molded in a unitary part.

As best shown in FIG. 1, each arm 20 of the illustrated embodiment comprises a recess 29 configured and disposed to receive a back side of the lever 22 connected to the other arm 20, thereby providing a lengthened stroke for the arms 20. This feature can also be omitted, if not desired.

The illustrated book holder 10 can be used either as a handheld device or as a self-supported device. For instance, the book holder 10 can be used without being held by a user's hand simply by putting the open book and the associated book holder 10 on a supporting surface, with pages facing up or down. It can also be provided with a system for supporting it. The illustrated book holder 10 comprises a support system in the form stabilization members pivotally connected to the back member 12. The stabilization members are configured and disposed to keep the book holder 10 in a standing position on a support surface, which surface is usually horizontal. In the upstanding position, the pages of the book in the book holder 10 can define a substantially orthogonal angle with the support surface or be inclined with reference thereto so as to facilitate the reading by the user. A slight angle generally provides a better stability to the standing book holder 10. The stabilization members of the illustrated embodiment comprise two substantially flat flaps 40 having a substantially vertical edge pivotally connected to a respective end of the back member 12 by means of a corresponding hinge 42. Each flap 40 comprises a surface-engaging edge 50 at a bottom side thereof. The flaps 40 are movable between a closed position where they are resting against the back side of the back member 12, and an open position where the flaps 40 are substantially orthogonal with reference to the back member 12. In the open position, the surface-engaging edges 50 of the flaps 40 allow the book holder 10 to be defining a slight inclination with reference to the support surface. Each flap 40 also comprises a protrusion 46 configured and disposed to fit with interference in a corresponding hole 48 made through the back member 12, thereby releasably holding the flaps 40 in their closed position and preventing them from inadvertently moving. The flaps 40 can be released from the closed position by pushing on the protrusion 46 with a finger from the front side of the back member 12. A recess can also be provided at the back side of the back member at a location adjacent to a side of the flaps 40, thereby allowing a finger to lift the flaps 40 and release them from their closed position.

Figure 9:
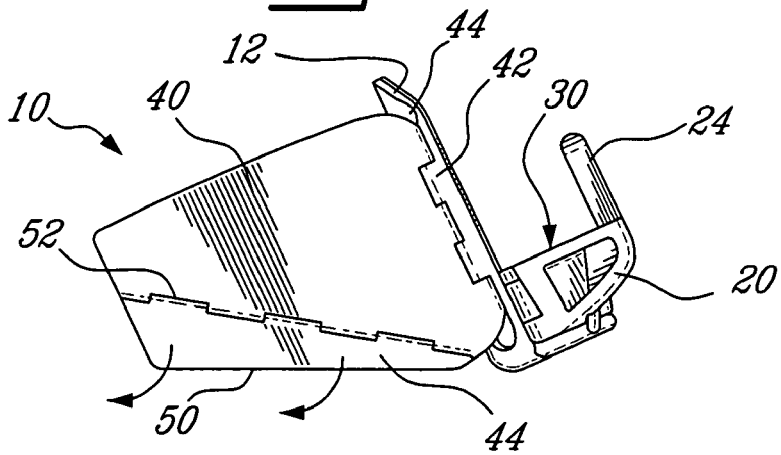
FIG. 9 is a view similar to FIG. 8, showing a possible system for adjusting the inclination angle between to back member and a support surface.

The book holder 10 can be provided with a system for adjusting the inclination angle between the back member 12 and the support surface. FIG. 9 shows an example of such system. In this example, each flap 40 comprises a hinged bottom portion 44 that can be pivoted to be out of engagement with the support surface, allowing another surface-engaging edge 52 to be exposed. This second edge results in that the book holder 10 is more inclined on the support surface compared to the first one.

Figure 10:
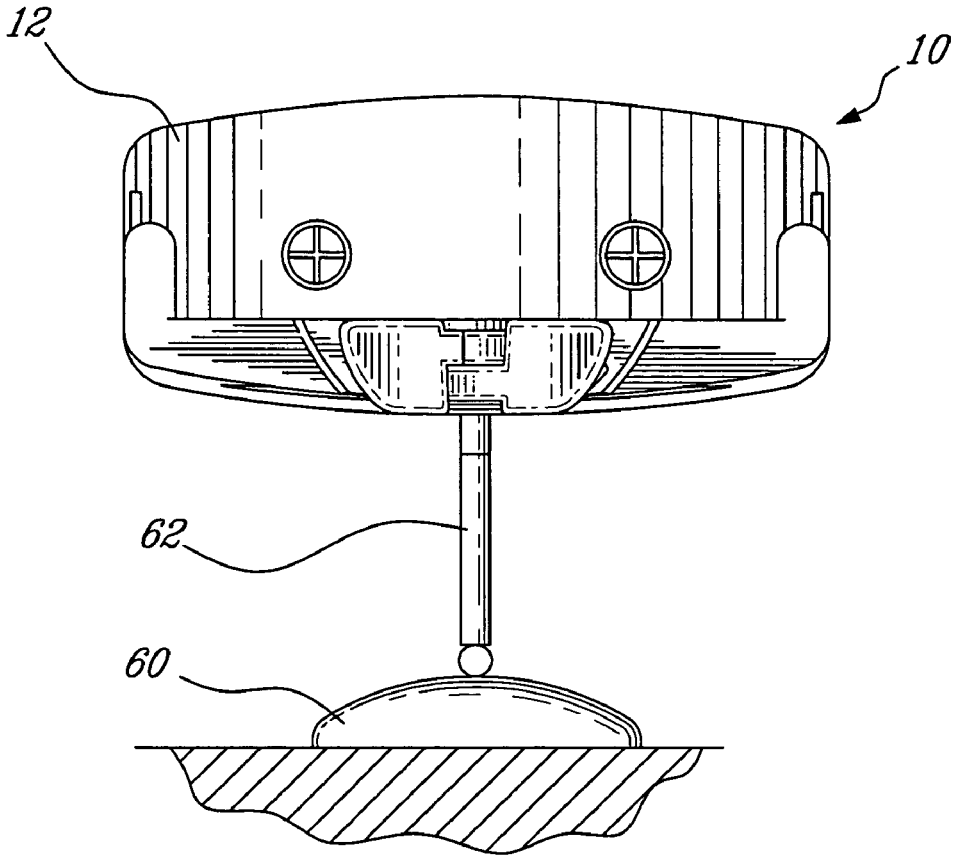
FIG. 10 is a front elevation view showing a possible system for securing the book holder to a fixed structure.

The book holder 10 can further comprise a system for temporarily or even permanently securing it to a fixed structure, for instance a bathroom wall or the surface of a bath. FIG. 10 shows an example of such system. In this example, a suction cup 60 is used to attach a stem 62, fixed to the main portion of book holder 10, to the side surface of a bath. The stem 62 can be screwed in a threaded hole (not shown) or be otherwise attached to the back member 12, for instance.

Figure 11:
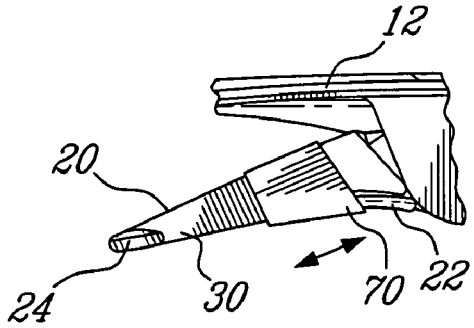
FIG. 11 is a partial top view of a possible system for locking the arms in an open position.

The book holder 10 can further comprise a system for selectively locking the arms 20 in a fully open position where the book receiving area has a maximum size. Locking the arms 20 in their maximum open position or near their maximum position allows inserting a book in the book holder 10 without having to depress the levers 22 at the same time. FIG. 11 shows an example of such system. In this example, a sliding sleeve 70 is provided on one of the arms 20, near the free end of the lever 22 attached to the opposite arm 20. The sleeve 70 is configured and disposed to be slid over that lever 22 when it is fully depressed. This keeps the lever 22 and that arm 20 together. The second arm 20 will then be dependent on the position of the first arm 20 with reference to the back member 12. The size of the book receiving area is maximized when the dependent arms are centered. It can also be maximized on one side at a time by pivoting one side until the page pressing member 24 contacts the back member 12. Therefore, the page pressing member 24 on the opposite side will have a maximum distance with reference to the back member 12. The same is true without the locking system. Maximizing the distance between the page pressing member 24 of one side and the back member 12 allows more easily inserting a thick side of a book. To release the locking system, the user may simply slide the sliding sleeve 70 out of engagement with the corresponding lever 22. The user may also apply a force on the corresponding lever 22 prior to sliding the sleeve 70 so as to avoid the arms from moving too quickly due to the spring force.

In use, one edge of the book holder 10 is inserted in a book receiving area defined between the back member 12, the arms 20 and the page pressing members 24. Once in position, the pages of the book will be retained but turning the pages is still possible with the book holder 10. It should be noted that pages of books can be turned from the right to the left side, or from the left to the right side. Books can also be printed with one side over another, meaning the pages can be turned from top to bottom, or from bottom to top. Each time, pages are pivoted with reference to a spinal axis, which axis is generally defined by the spine of the book or the equivalent thereof. Pages are moved with reference to an axis referred to the transversal axis, which axis is generally perpendicular to the spinal axis.

To insert an open book in the book holder 10, a user depresses one of the finger-actuated levers 22 for moving one arm 20, thereby lifting a first page pressing member 24 and creating a first space for inserting a first side of the edge of the book between the first page pressing member 24 and a back member 12. Simultaneously, or immediately after, the user depresses the other finger-actuated lever 22 for moving another arm 20, thereby lifting a second page pressing member 24 and creating a second space for inserting the second side of the edge of the book between the second page pressing member 24 and the back member 12. Subsequently, the user releases the first and the second levers 22, thereby allowing the first and the second page pressing member 24 to rest against pages of the book as they are each being biased by the spring force so that the book is being held between the page pressing members 24 and the back member 12. It should be noted that the first lever 22 can be released before or after the second lever 22 is depressed. Still, the second lever 22 can be released before the first lever 22 is released.

To turn one or more pages of the open book set in the book holder 10, the user lifts the first page pressing member 24 from the pages of a first side of the book by applying a depressing force on the first finger-actuated lever 22. The page or pages can then move from the first side of the book towards a second side thereof. Simultaneously, or once the page or pages are removed from the first side, the user lifts the second page pressing member 24 by applying a depressing force on the second finger-actuated lever 22. The page or pages taken from the first side can then be inserted onto the second side of the book. Once the page or pages are turned, the user releases the depressing forces. It is also possible for the users to release the depressing force on the first lever before applying the depressing force on the second lever.

The specific elements shown in the figures and described in detail here above are only examples of what can be used to construct a book holder as defined in the appended claims. It must also be understood that these claims are intended to cover all of the generic and specific features of the book holder herein described. Various equivalents, sub-combinations of elements and additional features are intended to fall within the language defined in the appended claims. The following text section provides examples of some of these possible equivalents, sub-combinations of elements and additional features. Other ones are also possible.

A friction lining can be provided on at least a portion of the front side of the back member 12 for further preventing the book mounted on book holder 10 from slipping out of place. It may comprise a cushion on the bottom edge to improve comfort. This cushion may be realized using a dual-injection method, for instance. The front side of the back member 12 may comprise a back rib forwardly projecting parallel to the spinal axis at a medial location thereof. This back rib will be in contact with the spine of the book once the book is set in the book holder 10. The back member 12 may further comprise an extension stem, removable or not, upwardly projecting in the spinal axis for supporting oversized books or equivalents in the form of long and soft paper sheets. The back member 12, its friction lining, or any other outer surface of the book holder 10 may be customized with text, trademarks or logos, thereby allowing the book holder 10 to be used as a promotional item.

The displacement of the arms 20 is not necessarily a pivot movement. Arms can be moved by a linking mechanism moving them in a parallel or a semi-parallel manner with reference to the back member 12. Still, each arm 20 can be mounted on its own pivot axis. The pivot movement of the arms can be realized using an arrangement that do not involve the use of a pivot pin. For instance, the end of the arms 20 can be connected to the back member 12 using tabs with protrusions inserted in a corresponding hole. Other mechanisms similar mechanisms can also be devised.

Although the illustrated embodiment shown the arms 20 being independent, the movement of the arms 20 can be made dependent using an appropriate mechanical connection. This can be realized with the use of one or two levers 22. In the case of a book holder 10 using only one lever 22, it is possible to design the book holder 10 so that the lever 22 moves both arms 20 at the same time or even one arm 20 for a first part of the stroke of the lever 22, then the other arm 20 for the last part of the stroke of the lever 22. The arms 20 need not necessarily have the same shape as in the illustrated embodiment. For instance, the arms 20 are not necessarily tapered.

The page pressing members 24 may be provided with or without a friction lining 24*a*. Each page pressing member 24 may also be provided with a partial friction lining 24*a* or another convenient feature, such as a roll having an axis parallel to the back member 12 and designed to be in contact with the pages of the open book. This further facilitates, for instance, the removal of the pages from one side of the book. The page pressing members 24 are not necessarily located at the free end of their corresponding arms 20 and may be located, for instance, at an intermediary location, if desired. The page pressing members 24 may define an angle with reference to the back member 12 so that both are not necessarily parallel, as shown in the illustrated embodiment. Pages pressing members 24 may be made integral with the arms 20 and be less distinctive than what is shown in the illustrated embodiment. They can also be pivotally connected to the arms 20 and biased by a spring. Still, the pages pressing members 24 can be made transparent so that one can read something printed or illustrated near the edge where the book holder 10 is located.

The one or the two levers 22 can be provided at the back of the book holder 10 to move the arms 20 at the front. While located at the front or at the back, they can be depressed toward each other, for instance being pinched, to move the arms 20. The levers 22 would then be in a V-shaped configuration with the corresponding arm 20. This embodiment may be easier to use for some people, for instance young children. Still, a third lever can be provided for a special function, for instance the function of moving the two arms 20 together, whereby the other two arms 20 are designed to move the arms 20 independently. Levers 22 are not necessarily made integral with their corresponding arm 20, as in the illustrated embodiment, and they are not necessarily identical. They can be designed so that they are connected to the arms using a distinct mechanical connection, either removable or not, such as a screw or a rivet. Using only one lever 22 to move only one arm 20 is possible. The other arm 20 could be moved using another mechanism or even manually.

The book holder 10 can be designed without the flanges 14, 16, especially the bottom flange 16. As aforesaid, other ways of connecting the arms 20 to the back member 12 can be devised. The upper flange 14 could be omitted. For instance, the back member 12 can be provided with an enlarged base on which the edge of the book rests. The support surface 30 of the arms 20 may also be used alone to support the edge of the book.

Whereas a single torsion spring 28 is used in the illustrated embodiment, it is understood that more than one torsion spring can be used, for example, one torsion spring can be used for each arm 20. Other systems for biasing the arms 20 so as to urge the page pressing members 24 toward the back member 12 can be used. The spring or springs may be of another type and consist, for instance, of a leaf spring. The use of an adjustable spring is another option. For instance, a screw or another actuation system can be provided to wind or unwind the spring, thereby modifying the spring force. The spring, springs or any other kind of biasing system are not necessarily nested between the two spaced-apart flanges 14, 16. They can be made visible to be provided inside the arms 20, for instance. Still, the natural spring force of a bended arm 20 can also provide the required spring force for create the bias.

The stabilization members can be different from that of the illustrated embodiment. Rotatable or otherwise movable back arms can be provided instead of flaps 40. The length of these arms can be adjustable to change the inclination angle, for instance. Still, the flaps 40, arms or any kind of stabilization members can be made detachable at different location, for instance, thereby providing another way of adjusting the inclination angle. Moreover, the system for releasably holding the stabilization members or flaps 40 in a closed position against the back member 12 on a side opposite the book receiving area can be different than what is shown in the illustrated embodiment. This system may include a hinged lock or a locking pin, for instance. Other variants can be devised as well.

Besides the stabilization members, the support system for the book holder 10 can also include alternative design. For instance, it may comprises a suction cup, a beanbag, a soft cushion, an inflatable balloon or any similar kind of portable object attached to the book holder 10 using an adjustable or fixed-length pole. They can also be directly connected thereto. A soft cushion can be used for reading while lying down. For example, the soft cushion can be placed on the reader's chest when lying down, thereby providing a deformable base that can conform to the surface it is placed on. An adjustable pole can extend from the soft cushion and connected to book holder 10. An inflatable balloon base can similarly be used so as to provide a relatively easy mobility by being able to be deflated and packed away when traveling and inflated prior to being used. The connection of a support system with the book holder 10 can be removable, for instance including a threaded hole in which a complementary threaded member can be screwed. Other support systems may include a tripod, a handle, etc. to maintain the book in the desired position. Furthermore, whereas attachments for book holder 10 can be connected to book holder 10 at various locations, bottom surface can provide for a relatively easy attachment. For example, bottom surface can comprise a threaded member suitable for engaging a threaded member of an attachment, such as an adjustable pole of a soft cushion. The support system may further include holes made through the book holder 10 and screws to be attached to a wall or other fixed structure. Other support systems can be devised.

The locking system for keeping the arms in their open position can include two sliding sleeves, one for each arm, or other kind of system. For instance, it may include a built-in mechanism, such as of a ratchet type. Other locking systems can be devised for that purpose.

The exact size and shape of the book holder 10 can be modified to accommodate various kinds of books and user's requirements. One of such requirements can be to provide the book holder 10 sized to be very compact and easy to carry in a small bag, a pocket or the like, which is something possible with the book holder 10. However, other needs may dictate other designs that are not necessarily very compact.

Although plastic is the prime candidate as the material for building most of the book holder 10, other materials can be used. For instance, a fully or almost-fully metallic book holder 10 can be made, including sliver or even gold plated.

Thus, while there have been shown and described and pointed out novel features of the present invention as applied to preferred embodiments thereof, it will be understood that various omissions and substitutions and changes in the form and details of the disclosed invention may be made by those skilled in the art without departing from the spirit of the invention. For example, back member 12 can be constructed to be short and elongated as shown in FIGS. 1-7 or alternatively, back member 12 can be longer and narrower, have a certain degree of curvature, etc. in accordance with the invention as a matter of application specific to design choice. Furthermore, book holder 10 can be constructed to hold a book in the closed position, thereby protecting its edges, marking the last page read, etc., without deviating from the scope of the invention. It is the intention, therefore, to be limited only as indicated by the scope of the claims appended hereto.

It is also to be understood that the following claims are intended to cover all of the generic and specific features of the invention herein described and all statements of the scope of the invention which, as a matter of language, might be said to fall therebetween.

What is claimed is:

1. A book holder for holding a book in an open displayed manner, the book holder comprising:

a back member;

two opposite and independently-displaceable arms pivotally connected to a front medial location of the back member wherein both arms have one end connected to a common pivot pin;

two page pressing members, each page pressing member being connected to one corresponding arm, the page pressing members, the arms and the back member defining a book receiving area to receive an edge of the book;

means for biasing the arms so as to urge the page pressing members toward the back member; and two finger-actuated levers, each lever being connected to one corresponding arm to pivot the corresponding arm, when depressed, thereby displacing the corresponding page pressing member away from the back member.

2. The book holder of claim 1, wherein each page pressing member is provided at a free end of its corresponding arm.

3. The book holder of claim 1, wherein each lever is connected to the end of its corresponding arm that is adjacent to the pivot pin, the levers being disposed in a crisscross configuration and each lever being depressed toward the back member to pivot its corresponding arm against a force generated by the means for biasing the arms.

4. The book holder of claim 3, wherein each arm comprises a recess configured and disposed to receive a back side of the lever connected to the other arm, thereby providing a lengthened stroke for the arms.

5. The book holder of claim 3, wherein each lever is made integral with the corresponding arm.

6. The book holder of claim 1, wherein the pivot pin extends between two spaced-apart and parallel flanges projecting from the back member.

7. The book holder of claim 6, wherein the means for biasing the arms comprise at least one spring cooperating with the arms and being nested within the flanges.

8. The book holder of claim 7, wherein the spring is a torsion spring.

9. The book holder of claim 7, wherein the flanges project from the front medial location on the back member.

10. The book holder of claim 1, further comprising means for selectively locking the arms in a fully open position where the book receiving area has a maximum size.

11. The book holder of claim 1, wherein each page pressing member further comprises a friction lining on a side facing the back member.

12. The book holder of claim 1, wherein the back member farther comprises a friction lining on a side adjacent to the book receiving area.

13. The book holder of claim 1, further comprising means for supporting the book holder.

14. The book holder of claim 13, wherein the means for supporting the book holder comprise stabilization members pivotally connected to die back member, the stabilization members being configured and disposed to keep the book holder in an upstanding position on a support surface.

15. The book holder of claim 14, wherein the stabilization members are two in number, each member being connected to a respective end of the back member.

16. The book holder of claim 15, further comprising means for releasably holding the stabilization members in a closed position against the back member on a side opposite the book receiving area.

17. The book holder of claim 14, wherein each stabilization member comprises a flap having a surface-engaging edge at a bottom side thereof.

18. The book holder of claim 14, further comprising means for adjusting an inclination angle between the back member and the support surface on which the book holder is set.

19. The book holder of claim 1, further comprising means for securing the book holder to a fixed structure.

20. A book holder to be attached to a bottom or an upper edge of an opened book, the book generally defining a spinal axis and a transversal axis that is perpendicular to the spinal axis, the book holder comprising:

a back member generally extending in the transversal axis;

two opposite arms generally extending in the transversal axis, the arms being movable between a first and a second position, whereby opposite free ends of the arms are closer to the back member when the arms are in their first position than in their second position, each arm being provided with a page pressing member that is connected thereto and is generally extending parallel to the spinal axis;

means for operatively connecting the arms at a medial position on the back member;

at least one spring configured and disposed to urge the arms toward their first position; and means for selectively moving at least one of the arms, using a finger-generated depressing force, toward its second position;

means for supporting the book holder comprising stabilization members pivotally connected to the back member, the stabilization members being configured and disposed to keep the book holder standing on a support surface;

wherein the stabilization members are two in number, each member being connected to a respective end of the back member; and further comprising means for releasably holding stabilization members in a closed position against the back member.

21. The book holder of claim 20, wherein each page pressing member is provided at the free end of its corresponding arm.

22. The book holder of claim 20, wherein the means for operatively connecting the arms on the back member comprise a pivot pin.

23. The book holder of claim 22, wherein the means for selectively moving at least one of the arms comprise a pair of levers, each lever being connected to one corresponding arm at a location adjacent to the pivot pin, each lever being configured and disposed to be depressed toward the back member so as to pivot its corresponding arm against a force generated by the at least one spring.

24. The book holder of claim 23, wherein each lever is made integral with its corresponding arm and the corresponding page pressing member.

25. The book holder of claim 22, wherein the pivot pin is supported by and is mounted between two spaced-apart and parallel flanges projecting from the back member, the flanges substantially extending in a plane parallel to the transversal axis.

26. The book holder of claim 25, wherein the at least one spring is nested between the flanges.

27. The book holder of claim 26, wherein the at least one spring is a torsion spring.

28. The book holder of claim 25, wherein the flanges project from a front medial location on the back member.

29. The book holder of claim 20, further comprising means for selectively locking the arms in the second position.

30. The book holder of claim 20, wherein each page pressing member further comprises a friction lining on a side facing the back member.

31. The book holder of claim 20, wherein the back member further comprises a friction lining on a side facing the page pressing members.

32. The book holder of claim 20, wherein each stabilization member comprises a flap having a bottom surface engaging edge.

33. The book holder of claim 32, further comprising means for adjusting an inclination angle between the back member and the support surface.

34. The book holder of claim 20, further comprising means for securing the book holder to a fixed structure.

35. A book holder for keeping a book open, the book holder comprising:

a back member;

a pair of spaced-apart and substantially parallel flanges projecting from a front side of the back member, one of the flanges defining a central support surface;

two oppositely-disposed arms, each arm having a first end, a second end and an elongated body, the first ends of the arms being positioned between the flanges, the body of each arm defining a lateral support surface, the lateral support surfaces being coplanar with the central support surface;

at least one pivot pin mounted between the flanges and connecting to first ends of the arms to the flanges;

at least one spring cooperating with the arms to bias the second ends of the arms toward the back member; and two finger-actuated levers, each lever being connected to the first end of the corresponding arm and being located opposite to body of the corresponding arm with reference to pivot pin.

36. The book holder of claim 35, wherein the at least one pin to which the first ends of the arms are connected comprises a common pivot pin.

37. The book holder of claim 36, wherein each lever is configured and disposed to be depressed toward the back member to pivot its corresponding arm opposite the direction of a force generated by the at least one spring.

38. The book holder of claim 37, wherein each arm comprises a recess configured and disposed to receive the lever connected to the other arm, thereby increasing a displacement range of the arms.

39. The book holder of claim 38, wherein each lever is made integral with the corresponding arm.

40. The book holder of claim 39, wherein the at least one spring is nested between the flanges.

41. The book holder of claim 40, wherein the at least one spring comprises a torsion spring.

42. The book holder of claim 35, further comprising means for selectively locking the arms in a fully open position.

43. The book holder of claim 35, wherein each arm is provided with a page pressing member orthogonally projecting therefrom in a direction substantially parallel to the back member.

44. The book holder of claim 35, further comprising stabilization members pivotally connected to the back member, the stabilization members being configured and disposed to keep the book holder in a standing position on a support surface.

45. The book holder of claim 44, wherein the stabilization members are connected to a back side of the back member.

46. The book holder of claim 45, further comprising means for releasably holding the stabilization members in a closed position against the back member.

47. The book holder of claim 45, wherein each stabilization member comprises a flap having a bottom surface engaging edge.

48. The hook holder of claim 44, further comprising means for adjusting an angle between the back member and the support surface on which the book holder is set.

49. The book holder of claim 35, further comprising means for supporting the hook holder.

50. The book holder of claim 35, further comprising means for securing the book holder to a fixed structure.

51. A book holder comprising:

a back member;

a pair of spaced-apart and substantially parallel flanges projecting from a front side of the back member, one of the flanges defining a central support surface for an edge of the book;

two oppositely-extending arms, each arm having an elongated body provided with opposite first and second ends, the first ends of the arms being positioned between the flanges and pivotally connected thereto, the body or each arm defining a lateral support surface for an edge of the book, the lateral support surfaces being substantially coplanar with the central support surface;

at least one spring cooperating with the arms to bias the second ends the arms toward the back member;

a finger-actuated lever, the lever being mechanically connected to the first end of a first one of the arms and extending opposite the body of the corresponding arm; and means for pivoting a second one of the arms so as to move the second end of the second arm away from the back member;

whereby the finger-actuated lever, when depressed, moves the second end of the first arm away from the back member.

52. The book holder of claim 51, wherein each arm has one end connected to a common pivot pin mounted between the flanges.

53. The book holder of claim 52, wherein the lever is made integral with the first arm.

54. The book holder of claim 53, wherein the at least one spring is nested between the flanges.

55. The book holder of claim 54, wherein the at least one spring includes a torsion spring.

56. The book holder of claim 51, further comprising means for selectively locking the arms in a position where the second end of the first arm is away from the back member.

57. The book holder of claim 51, wherein the back member further comprises a friction lining covering at least a portion of its front side.

58. The book holder of claim 51, further comprising stabilization members pivotally connected to the back member, the stabilization members being configured and disposed to keep the book holder in an upstanding position on a support surface.

59. The book holder of claim 58, wherein the stabilization members are two in number, each member being symmetrically connected to the back member.

60. The book holder of claim 58, further comprising means for locking the stabilization members when set in a closed position against a back side of the back member.

61. The book holder of claim 58, wherein each stabilization member comprises a substantially hat flap having a bottom engaging edge.

62. The book holder of claim 58, further comprising means for varying an inclination angle between the back member and the support surface on which the book holder is set.

63. The book holder of claim 51, further comprising means for securing the book holder to a portable object.

64. The book holder of claim 51, further comprising means for securing the book holder to a fixed structure.

* * * * *